US006073560A

United States Patent [19]

Stone

[11] Patent Number: 6,073,560

[45] Date of Patent: Jun. 13, 2000

[54] SABOT

[75] Inventor: Jeffrey Wayne Stone, Elizabethtown, Ky.

[73] Assignee: Remington Arms Company, Inc., Madison, N.C.

[21] Appl. No.: 09/037,169

[22] Filed: Mar. 9, 1998

[51] Int. Cl.[7] ..... F42B 14/06

[52] U.S. Cl. ..... 102/522

[58] Field of Search ..... 102/520–523, 102/532

[56] References Cited

U.S. PATENT DOCUMENTS

| | | | |
|---|---|---|---|
| 3,005,408 | 10/1961 | Prosen et al. | 102/522 |
| 3,164,092 | 1/1965 | Reed et al. | 102/522 |
| 4,296,687 | 10/1981 | Garrett | 102/523 |
| 4,864,934 | 9/1989 | Theising | 102/532 |
| 5,214,238 | 5/1993 | Young | 102/520 |

FOREIGN PATENT DOCUMENTS

| | | | |
|---|---|---|---|
| 1534004 | 7/1968 | France | 102/522 |
| 2308901 | 11/1976 | France | 102/532 |
| 78981 | 1/1895 | Germany | 102/522 |
| 427344 | 9/1948 | Italy | 102/520 |
| 2013312 | 8/1979 | United Kingdom | 102/520 |
| WO 83/01300 | 4/1983 | WIPO | 102/523 |

*Primary Examiner*—Harold J. Tudor
*Attorney, Agent, or Firm*—Rhodes & Mason

[57] ABSTRACT

The present invention relates generally to a one-piece sabot for holding a sub-caliber projectile. For use in muzzle loading and other firearms, the sabot includes a plurality of petals which, in one embodiment, encapsulate the projectile. The petals have a high mass portion near the barrel end of the sabot. The portions are subjected to a centrifugal opening force as the sabot exits the firearm barrel upon firing. The centrifugal force causes the petals to clear the flight path of the projectile quickly so that the sabot is less likely to interfere with accurate projectile flight. In one embodiment, the sabot may further include a protective surface for engagement with a ram rod and for protection of the encapsulated projectile, for increased aerodynamic stability.

12 Claims, 2 Drawing Sheets

SABOT

FIELD OF THE INVENTION

The present invention relates generally to a sabot for holding a sub caliber projectile. More particularly, the present invention relates to a sabot having improved loading, firing and projectile separation performance and is well suited for use in muzzle loading firearms.

BACKGROUND OF THE INVENTION

Despite the many advances that have been made to modern rifle design, muzzle loading rifles remain popular with firearms enthusiasts. The basic loading sequence for a muzzle loading rifle has not changed significantly since its inception. First, a quantity of black powder is poured into the barrel. Second, a wad, comprised of either cloth or leather, is pushed down the barrel and tapped against the black powder with a long rod to compact the powder. Third, a lead ball is pushed down the barrel in contact and on top of the wad.

The introduction of rifling into muzzle loader design greatly increased its accuracy. The benefits of imparting a spinning motion to any firearm projectile are well known. However, these benefits in a muzzle loader were offset partially by increased difficulties with loading. Projectiles had to be slightly oversized compared to gun barrel land-to-land diameter in order to ensure engagement with the barrel rifling. Even though projectiles were and are typically made of soft lead, it became very difficult to push the projectile down the barrel. In fact, the amount of force necessary to push the projectile down the barrel could sometimes deform the projectile causing erratic and therefore inaccurate flight.

Sabots address some of the above-described problems by providing a protective surface along the perimeter or sides of the projectile, which contacts with the rifle barrel during loading. Typically, sabots are slightly oversized with respect to the land-to-land inside diameter of a rifled gun barrel. Thus, the sabot exterior engages the barrel rifling, thus creating a stabilizing spinning motion to the projectile as it exits the firearm. Using a sabot also eliminates the use of the wad, since the sabot's closed base provides a seal for the gases generated during firing. After firing, the sabot is intended to quickly peel away from the projectile.

However, prior art sabot designs, for both military and civilian applications, have not adequately addressed loading problems, or taken advantage of improved design methods to ensure that the sabot effectively breaks free of the projectile after firing in order to not interfere with the projectile flight path. There remains a need for a sabot which is relatively easy to load, and that provides improved protection for projectiles, particularly those made of soft metal. Moreover, there remains a need for such a sabot which quickly clears the path of a projectile as it exits a firearm barrel without adversely affecting firearm accuracy.

SUMMARY OF THE INVENTION

The present invention relates to a one piece sabot for use with a sub-caliber projectile in a rifled firearm barrel. Although suitable for any such application, the invention is particularly useful with muzzle loading firearms.

The sabot of the present invention features a plurality of petals which extend from a base so as to form a cavity to envelope a projectile disposed within. In a preferred embodiment the sabot includes a front section, the front section constructed to release the projectile after firing as. a result of centrifugal force acting on the front section; and a back section. The sabot also includes a center section disposed between the front section and the back section wherein the front section has a higher mass than the center section. The sabot is oversized as compared to the land-to-land inside diameter of the gun barrel so as to be engraved in the lands during loading. The spinning thus created upon firing creates a strong centrifugal force which acts on the high mass front section to cause the petals to open rapidly. This rapid opening permits the projectile to clear the sabot quickly and minimizes any interference with the projectile travel created by the sabot.

The petals may further include a recess so as to form a portion of material of constant thickness along the length of the recess. In a preferred embodiment, the recess extends from the central section of the sabot to the front section of the sabot.

In a preferred embodiment the sabot includes a contact surface positioned on the front section for protective engagement with a ram rod. The sabot may also feature a boat tail shape in the back section for easier insertion into a barrel. Further, the back section may also include a semispherically shaped recess which may have the shape of a curve of constant radius. Alternatively the recess may comprise a curved section of constant radius centered on the sabot longitudinal axis with straight sections-extending therefrom on either side towards the end of the sabot.

The sabot of the present invention is readily adaptable for mass production out of suitable materials. A preferred material is linear low density polyethylene and a preferred method of manufacture is injection molding.

It should be understood that both the foregoing general description and the following detailed description are exemplary and explanatory only and are not restrictive of the invention as claimed.

The accompanying drawings, which are incorporated in and constitute a part of this specification, illustrate one embodiment of the invention and, together with the description, serve to explain the principles of the invention.

BRIEF DESCRIPTION OF THE DRAWINGS

The invention will be better understood after a reading of the Detailed Description of the Preferred Embodiments and a review of the drawings in which.

DETAILED DESCRIPTION OF THE PREFERRED EMBODIMENT

Figures 1, 2, 3, 4, 5, 6:
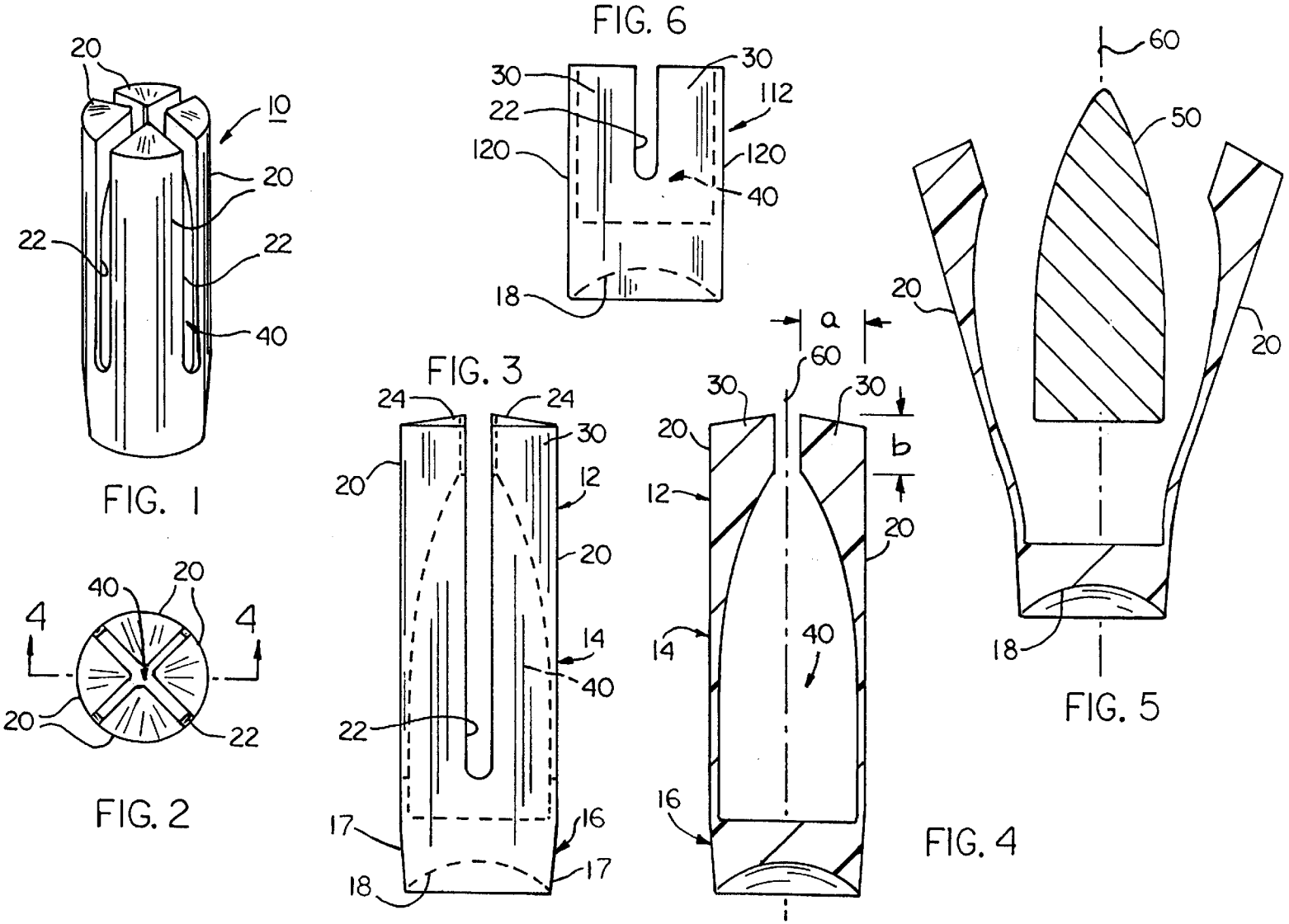
FIG. 1 is a perspective view of the sabot of the present invention.
FIG. 2 is a top view of the sabot of the present invention.
FIG. 3 is a side view of the sabot of the present invention showing the cavity contained therein for holding a projectile.
FIG. 4 is a sectional view taken along 4—4 of FIG. 2.
FIG. 5 is a partially cut-away side view of the sabot of the present invention showing the sabot petals in an extended position to permit the exit of a projectile.
FIG. 6 is a side elevational view of an alternative embodiment of the present invention.
Figure 9:
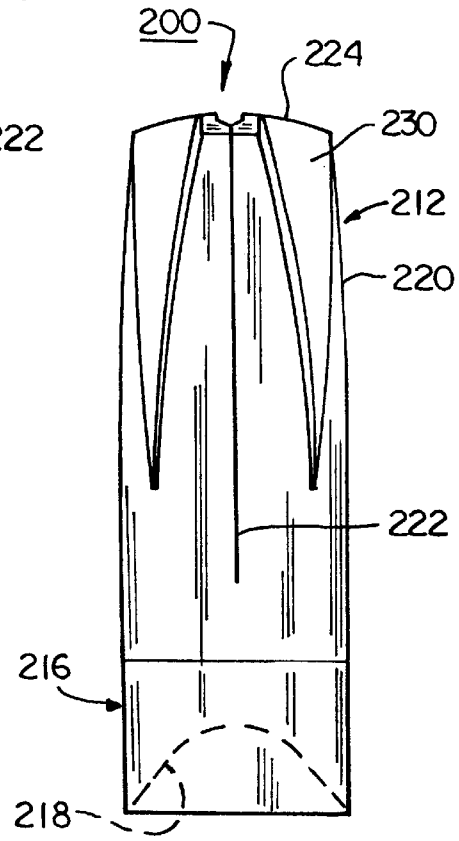
FIG. 9 is a side view of a third embodiment of the sabot of the present invention.
Figure 7:
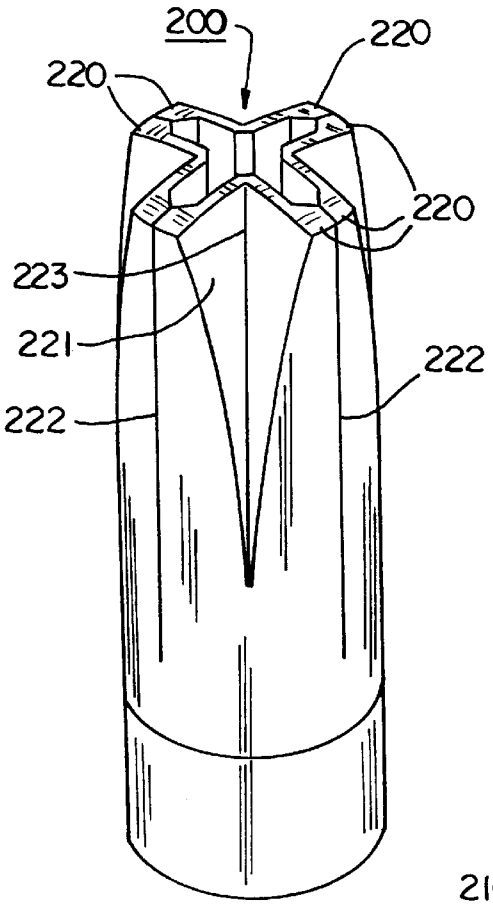
FIG. 7 is a perspective view of a third embodiment of the sabot of the present invention.
Figure 8:
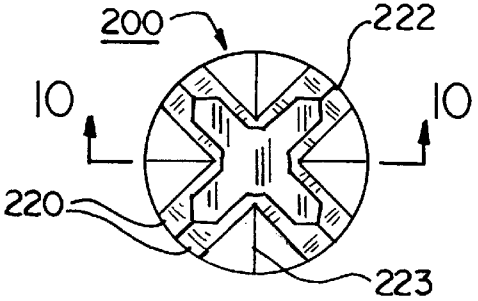
FIG. 8 is a top view of a third embodiment of the sabot of the present invention.

FIG. 1 depicts a perspective view of the sabot of the present invention illustrated generally at 10. The sabot 10 is a one piece sabot and includes a plurality of petals 20 which define a plurality of slots 22 therebetween.

A side view of the sabot is shown in FIG. 3. The sabot comprises a front section 12, a central section 14, and a back section 16. Front section 12 corresponds to the muzzle end of a firearm and back section 16 corresponds to the breech end of a firearm. Petals 20 extend from the back section 16 towards the front section 12. The petals 20 form an internal cavity 40 for holding a projectile 50. Each petal 20 further comprises a high mass portion 30 located at the front section 12.

FIG. 2 shows a top view of the sabot 10 as it may appear in a barrel prior to firing. In this Figure the petals 20 do not appear to touch but may in fact do so in an embodiment having a smaller slot width than that shown in FIG. 3. This smaller slot size is intended to address any tendency the sabot 10 may have to twist during firing.

In one embodiment, the sabot 10 may further include a semispherical recess 18 located at the back section 16 of the sabot 10, as shown in FIG. 3. When the projectile/sabot combination is rammed down the barrel of a muzzle loading rifle, semispherical recess 18 will tend to better compact the black powder. An additional benefit of semispherical recess 18 is believed to be better obturation performance by the sabot 10 upon firing. This improved performance occurs as gas pressure from the black powder charge tends to flatten the recess 18, pushing outward the walls of the recess 18, thus sealing the sabot 10 against the barrel rifling.

In yet another preferred embodiment, the back section 16 of the sabot 10 may include a boat tail end 17. This term is understood in the art to mean that the back section 16 tapers in diameter from the beginning of that section to the end of the sabot 10. This design feature eases the loading process. The diameter of the sabot 10 at the most narrow point of the boat tail end 17 will be less than the land-to-land diameter of the rifle barrel. Thus, the sabot 10 will be easier to insert into the rifle barrel and thus be pushed into position by a ram rod. The sabot diameter in the front section 12 and the central section 14 will be slightly larger than the land-to-land diameter so that the sabot 10 will be engraved upon the barrel rifling.

Each of the petals 20 further comprises a contact surface 24 in the front section 12 for a protective engagement with a ram rod. The contact surface 24 of each petal 20 forms a fractional part of a continuous conical across the end of the sabot 10 which faces the muzzle end of the barrel.

The practice of the present invention includes fabricating the sabot from any suitable material. Preferably the sabot is manufactured from plastic with linear low density polyethylene (LLDE). LLDE has excellent toughness, physical properties and engraving characteristics with barrel rifling. For example, upon firing, the sabot will obturate at the base engraving the rifling and imparting spin to the projectile/sabot system. The LLDE material will also flex along the sabot's peripheral side walls upon loading. This produces the force the shooter must supply to the projectile/sabot system via the ram rod when seating the system on the powder charge. Constructed in such a manner, a projectile is loaded into the sabot by peeling back or stretching slightly the front section 12 of the sabot, and inserting the projectile within the cavity 40. The elastic properties of the sabot allow the front section to return to an encapsulated state. Although a wide variety of plastic fabrication techniques may be employed to manufacture the sabot, injection molding is a preferred technique, thus resulting in a one piece or unitary construction. Such a construction greatly simplifies the manufacture of the sabot and reduces costs.

The details of the petal construction in a preferred embodiment are illustrated in FIG. 4 which is a cross sectional view of the sabot taken along 4—4 FIG. 2. The sabot 10 features petals 20 positioned in symmetrical fashion of either side of longitudinal axis 60 of the sabot. Each petal 20 has a high mass portion 30 located at the front section 12 of sabot 10. In this embodiment, the high mass portion 30 is formed by the gradually increasing cross sectional thickness of each petal 20 from the breech end to the muzzle end of each. As shown in FIG. 4, the petal top section 30 has a radial dimension, reference letter a, and a depth, reference letter b. As illustrated, the ratio of radial dimension a to depth b is approximately 1:1. The high mass portion 30 also defines the interior cavity 40, which can be designed to mate with a projectile. It will be readily understood that the sabot 10 and the projectile contained therein will be subjected to a spinning rotation as they exit the rifled barrel. This rotation will exert a centrifugal force on each petal 20. The force exerted along any point of the length of each petal 20 will be proportional to the mass of the petal at that point. Thus, the high mass portions will be subject to a relatively high point force operating in a direction substantially perpendicular to horizontal axis 60. Because each petal 20 is attached to back section 16, the resultant movement of each petal responsive to the centrifugal force will be as illustrated in FIG. 5. In that figure, each petal 20 has rotated to an open position. Effectively, each petal 20 is subjected to a moment arm action created about the point where each petal is attached to the back section 16. The centrifugal force acting on the front section 12 and concentrated at the locations of the high mass portions serves to promote the release of projectile 50 from sabot 10. As can be seen in FIG. 5, the petals 20 open quickly to create an exit path for projectile 50. Simultaneously, sabot 10 loses its initial relatively aerodynamic shape and takes on a shape which creates a great deal of drag. The speed of sabot 10 relative to projectile 50 decreases rapidly thus promoting separation of the sabot 10 from projectile 50.

The embodiment described thus far includes slots defined between the petals, the number of slots being dependant upon the number of petals. The length of these slots can vary. In general, petal length increases with slot length. The longer the petals, the greater the moment arm available for action by the centrifugal force described above. In an alternative embodiment (not shown) the petals may be joined together at longitudinal lines of weakness. Upon firing, petal separation takes place along these lines of weakness thus permitting the centrifugal force to facilitate petal opening.

The practice of the present invention includes sizing the sabot to accept a wide range of projectile sizes. Desirably, the sabot is sized to accept the projectile of between about .30 caliber and about .58 caliber with between about .45 caliber and about .50 caliber being particularly preferred. The sabot may be adapted to other calibers as well.

The preferred embodiment illustrated in FIGS. 1–5 features a structure which substantially encapsulates the projectile. However, other non-encapsulating sabot structures embodying the principles of the present invention may be provided. For example, petals 20 may have a length which extends only as far as the central section 14 shown in FIG. 3. A side elevation of this embodiment is illustrated in FIG. 6. This embodiment includes petals 120, high mass portion 130, a front section 112, an interior cavity 140 and slots 122 defined between petals 120. The shorter height requires that alternative methods be used to incorporate a high mass portion in the petals 120. In a first non-limiting example, the density of the material used to form the petals 120 may be increased at the front section 112 of the sabot. Thus, even though the thickness of petals 120 may be constant along their length, the mass subject to a centrifugal opening force will be greater at the front section 112. This resultant high density portion of each petal 120 will be subjected to a greater centrifugal opening force even though each petal 120 has a substantially constant thickness along its length. Alternatively, the mass of the central section 14 could be decreased by designing in the structure voids, channels or the like. Another alternative (not shown) would involve increasing petal thickness at the front section 112. However, as will be understood by one of ordinary skill in the art, this change may result in a cavity 140 having a smaller maximum diameter for accepting a projectile.

One advantage of the embodiment illustrated in FIG. 6 stems from the fact that its reduced length results in a sabot which may be easier to push down a rifled barrel. However, the embodiment shown in FIGS. 1–5 while potentially requiring more pushing force will have better obturation properties and will better engage the barrel rifling due to its extended length. Any potential difficulties with pushing the sabot down a rifled barrel may be addressed by application of a barrel lubricant.

Figure 10:
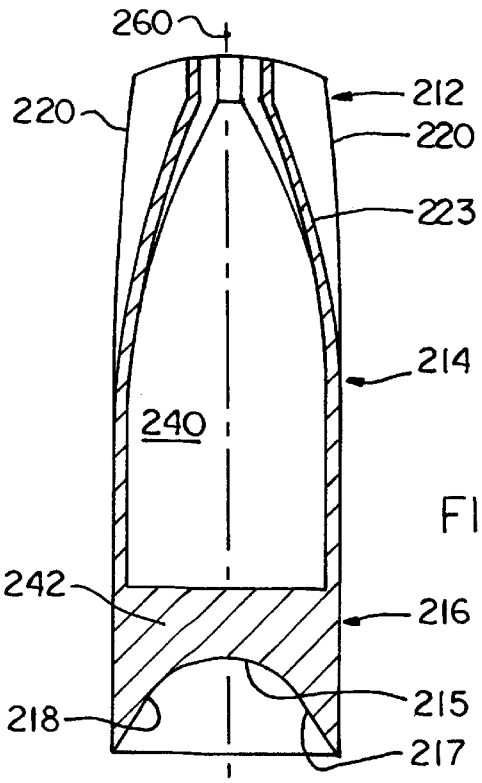
FIG. 10 is a sectional view taken along 10—10 of FIG. 8

Another alternative embodiment of the invention is illustrated in FIGS. 7–10 (referred to herein as the third embodiment). The third embodiment includes a front section 212, a central section 214, a back section 216, a high mass portion 230, an internal cavity 240 for holding a projectile, and a contact surface 224. This embodiment employs the same principle of operation with three modifications to the structure of the sabot 200. First, each petal 220 includes a recess 221 of gradually increasing depth extending from approximately the central section 214 to the front section 212. Recess 221 facilitates the manufacture of the sabot 200 from any type of plastic material by providing a continuous portion 223 of constant thickness material along the interior, curved side of each petal 220. This portion 223 of constant thickness is illustrated in FIG. 10 which is a sectional view taken along 10—10 of FIG. 8. The line of constant thickness 223 follows the shape of the interior-facing curved portion of each petal 220. It has been found that the lines of constant thickness 223 permit the sabot 200 to be manufactured according to closer tolerances and otherwise improve the quality of the finished molded product. Although recess 221 is shown in FIGS. 7–10 as a v-shaped recess, the practice of the present invention includes using other shapes as well. It should be understood that the practice of the present invention includes forming recess 221 without creating a line of constant thickness 223.

This third embodiment also features very narrow slots 222 between each petal 220. By way of non-limiting example, the slots in the embodiment shown in FIGS. 1–5 may use a slot width of about 0.075 in., while the embodiment of FIGS. 7–10 may use a slot width of about 0.005 to about 0.010 in. The actual width used will depend on the limitations of the plastics manufacturing equipment available. It has been found that if wider slots 222 are used, the sabot 10 may tend to experience excessive twisting as it is being pushed down a barrel and again during firing. This twisting makes pushing the sabot/projectile system down the rifle barrel much more difficult. Moreover, it is believed that the twisting may affect accuracy during firing. Decreasing the width of slots 222 increases the overall rigidity of the sabot 200 and has been observed to reduce the amount of effort required to push the sabot/projectile system down a rifled barrel.

The third embodiment also incorporates a different type of semispherical recess 218. Here the recess is formed by a curved portion 215 of constant radius which is centered on the longitudinal axis 260 of the sabot. Extending from either side of curved portion 215 are straight portions 217 which extend to the end of the sabot. It should be understood that the term "semispherical recess" as used herein includes a recess 18 (FIG. 3) having a constant radius from one side of the sabot to the other as well as recess 218 of FIG. 10 which is composite of a curved and a straight portion. It has been found that the semispherical recess shape of FIG. 10 along with a base section 242 of increased thickness provides better obturation performance.

Although the present invention has been described with preferred embodiments, it is to be understood that modifications and variations may be utilized without departing from the spirit and scope of this invention, as those skilled in the art would readily understand. Such modifications and variations are considered to be within the purview and scope of the appended claims and their equivalents.

What I claim is:

1. A one-piece sabot comprising:

a front section;

a back section having a semispherical recess;

a plurality of petals extending from the back section to the front section and defining a plurality of slots therebetween;

whereby each petal increases in cross-sectional thickness from the back section to define an internal cavity between said plurality of petals, the internal cavity being of sufficient size to receive and completely encapsulate a projectile inserted therein;

each of the plurality of petals having a petal top section that defines a depth; and the plurality of petal top sections define a conical contact surface having a center, and with each petal top section having a radial dimension, whereby the ratio of the depth to the radial dimension is approximately 1:1 and the petal top sections slant outwardly downwardly from the center of the contact surface.

2. The sabot of claim 1 wherein the back section is a boat tail end.

3. The sabot of claim 1 wherein the sabot is used in conjunction with a firearm having a barrel and the contact surface diameter is larger than the barrel land-to-land distance.

4. The sabot of claim 1 further comprising a central section medial to the front and back sections.

5. The sabot of claim 4 wherein the front section has a higher mass than the central section.

6. The sabot of claim 1 wherein the sabot is used in conjunction with a muzzle-loading firearm.

7. The sabot of claim 6 wherein the contact surface provides a protective barrier for engagement of the sabot with a ramrod.

8. The sabot of claim 1 wherein the internal cavity is sized to accept a projectile of between about .30 and .58 caliber.

9. The sabot of claim 1 wherein the internal cavity is sized to accept a projectile of between about .45 and .50 caliber.

10. The sabot of claim 1 wherein the petal tops are subjected to a centrifugal opening force as the sabot exits a rifled barrel.

11. The sabot of claim 1 wherein the sabot is formed of linear low density polyethylene.

12. A one-piece sabot for a muzzle-loading firearm having a barrel comprising:

a front section having a diameter larger than a barrel land-to-land distance;

a back section having a boat tail end with a semispherical recess;

a plurality of petals extending from the back section to the front section and to define a plurality of slots therebetween;

each petal increases in cross-sectional thickness from the back section to define an internal cavity between said plurality of petals, the internal cavity being of sufficient size to receive and completely encapsulate a projectile having a caliber between about .30 and .58 caliber;

each of the plurality of petals having a top section defining a depth;

each petal top section comprising a single, surface wherein the petal tops are subjected to a centrifugal opening force as the sabot exits a rifled barrel; and the plurality of petal tops define a conical contact surface, each petal top having a radial dimension wherein the ratio of the depth to the radial dimension is approximately 1:1 and the contact surface has a center and each petal top slants outwardly downwardly from the center of the contact surface to provide a protective barrier for engagement of the sabot with a ramrod.

* * * * *